US005613381A

United States Patent [19]

Savage

[11] Patent Number: 5,613,381

[45] Date of Patent: Mar. 25, 1997

[54] HANDCUFF

[76] Inventor: Julie M. Savage, 426 E. First St., Jennings, La. 70546

[21] Appl. No.: 415,192

[22] Filed: Apr. 3, 1995

[51] Int. Cl.[6] ..... E05B 75/00

[52] U.S. Cl. ..... 70/16; 70/18

[58] Field of Search ..... 70/14–18; 119/726, 119/857

[56] References Cited

U.S. PATENT DOCUMENTS

| | | | |
|---|---|---|---|
| 372,510 | 11/1887 | Bean . | |
| 539,650 | 5/1895 | Searle | 70/16 |
| 583,796 | 6/1897 | Ferrell | 70/16 |
| 1,342,334 | 6/1920 | Kruger . | |
| 1,856,427 | 11/1929 | Pratt . | |
| 1,984,677 | 9/1932 | Harrington . | |
| 2,465,008 | 3/1949 | Carlson | 70/49 |
| 2,966,787 | 1/1961 | Thompkins . | |
| 3,146,614 | 9/1964 | Von Frantzius . | |
| 3,585,823 | 6/1971 | Nagel | 70/49 |
| 3,616,665 | 11/1971 | Rosenthal . | |
| 3,740,977 | 6/1973 | Stefansen et al. | 70/16 |
| 4,112,716 | 9/1978 | Wippich | 70/49 |
| 5,007,257 | 4/1991 | Thompson | 70/16 |
| 5,233,848 | 8/1993 | Elam | 70/16 |

*Primary Examiner*—Darnell M. Boucher
*Attorney, Agent, or Firm*—William W. Stagg

[57] ABSTRACT

An improvement in a handcuff having a rigid central body and lockable wrist shackles for use in conjunction with a prisoner's waist chain. The central body of the handcuff has a slot for receiving a link from the waist chain and a dead bolt and lock set means mounted within the central body of the handcuff for extending the dead bolt through the slot to engage and hold the prisoner's waist chain.

9 Claims, 3 Drawing Sheets

HANDCUFF

FIELD OF INVENTION

The present invention generally relates to the field of prisoner handcuffs and more particularly, relates to an improved handcuff design which will allow easier and safer attachment of the handcuffs to a prisoner's waist chain.

BACKGROUND OF THE INVENTION

Over the years a number of handcuff designs have been put forward to improve the techniques for detaining prisoners. These designs typically incorporate a spring biased manacle which engages a detent or pawl to prevent backward or opening movement of the manacle. These designs are generally illustrated in U.S. Pat. No. 2,966,787 to Tompkins and U.S. Pat. No. 3,146,614 to Von Frantzius.

The art is also illustrated in U.S. Pat. No. 372,510 to Bean which discloses a set of handcuffs with a rigid central casing containing a key operated locking mechanism and U.S. Pat. No. 1,342,334 to Kruger which discloses a handcuff assembly having elements similar to Bean but having a combination type lock for disengaging the lock pawls and a removable outer plate for access to the locking mechanism.

Further, U.S. Pat. No. 1,856,427 to Pratt discloses a pair of individually adjustable cuffs connected to a rigidly central stock that may be converted into a nipper and U.S. Pat. No. 1,984,677 to Harrington discloses a device for locking the rotating arm of a handcuff against rotation in either direction. In addition, U.S. Pat. No. 3,616,665 to Rosenthal discloses a removable shield for attachment over the central portion of a conventional set of handcuffs connected by a chain. The shield, comprised of a pair of parallel plates fits over the connecting chain. Elongated openings (14 and 15 in FIGS. 2 and 3 of Rosenthal) formed into the face of the plates are aligned to receive a prisoner's waist chain, much like running a thread through the eye of a needle. The chain must then be secured around the prisoner's waist by a lock or other means. The waist chain when position through the elongated openings in the shield, below the handcuff chain, prevents removal of the shield.

Attaching the handcuffs to a waist chain is a desirable and common practice for handling and controlling prisoners. It provides greater security and safety for the guards and for others in the area. However, running a waist chain through an opening in the handcuffs, or a shield as in Rosenthal, and then securing the chain around the prisoners waist is time consuming and may be difficult and dangerous if the prisoner is resisting.

None of these devices provide a quick, safe and efficient means for attaching the handcuffs to a prisoner's waist chain. Consequently, a need exists for an improved handcuff design to provide a means for quick and efficient attachment of a prisoner's waist chain to the handcuffs.

SUMMARY OF THE INVENTION

The present invention is designed to satisfy the aforementioned needs. It is comprised of a handcuff assembly having a rigid central body portion connected to a pair of pivoted revolving wrist cuffs. The central body portion of the handcuff assembly contains a horizontal slot designed to receive a link from a prisoner's waist chain. Positioned within the central body portion is a locking element to move a vertical dead bolt through the horizontal chain slot. When a chain link from the prisoner's waist chain is inserted in the slot, the dead bolt is passed through the link securing the chain to the handcuff assembly. The wrist cuffs and the dead bolt open, close and lock with a single key.

DESCRIPTION OF THE PREFERRED EMBODIMENTS

Figure 1:
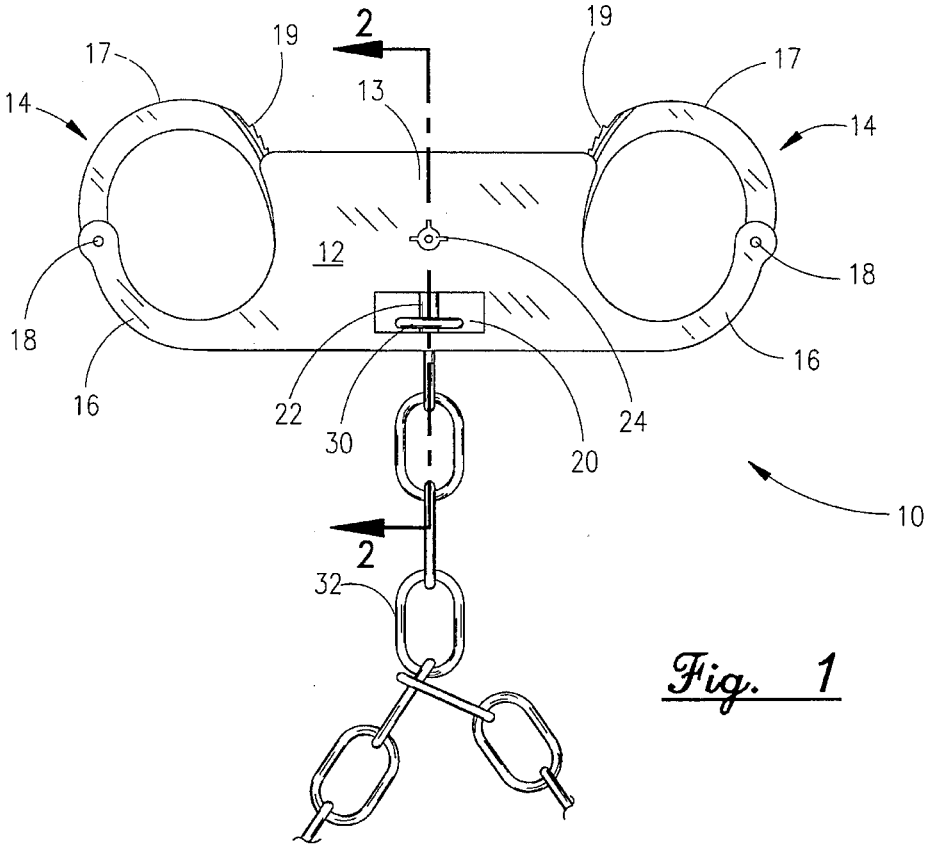
FIG. 1 shows a front view of the handcuff assembly.

Referring now to the drawings and more particularly to FIG. 1, there is shown a front view of the improved handcuff generally designated 10. The handcuff 10 is comprised of a central rectangular rigid body portion 12 with a wrist cuff 14 at each end of the body 12. The central body 12 is comprised of rigid parallel plates 13 and 15 which extend and are shaped to form a fixed portion 16 of the wrist cuffs 14, integral with the central body 12. A shackle 17 for the wrist cuff 14 is attached to the fixed portion 16 by means of a hinge 18 so that is swings through the plates 13 and 15 of the body 12. Each shackle 17 has teeth 19 which engage teeth 31 of pawl 33 of a central locking mechanism 26, not shown, within the body 12 to secure the shackle and retain the prisoner's wrist within the wrist cuff 14.

Situated within the rigid body portion 12, ending through plates 13 and 15, is a rectangular waist chain slot 20. The slot 20 is designed to have sufficient width and height to receive a link from a prisoner's waist chain. A dead bolt 22 is shown in a closed position across the width of the slot 22. The dead bolt is moved from an open to a closed position also by means of the central lock mechanism 26, not shown in FIG. 1, through keyhole 24.

Figure 2:
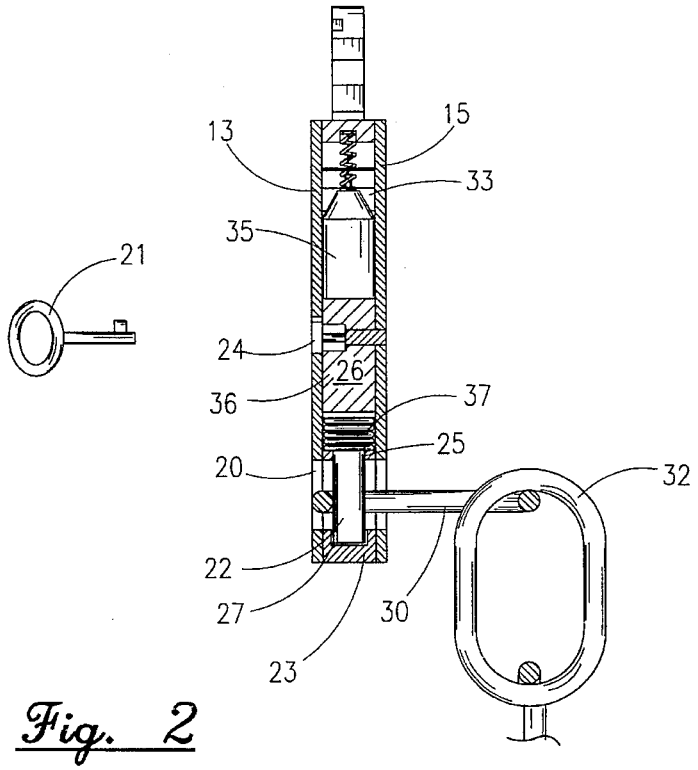
FIG. 2 shows a cross-sectional end view of the handcuff assembly.

As shown is FIG. 2, the slot 20 is bordered around its periphery by an edge or lining plate 23 between parallel plates 13 and 15. A dead bolt 22 moves across waist chain slot 20 through a bolt opening 25 in the edge plate 23 by means of a tubular key 21 inserted in key hole 24 to engage the central lock mechanism 26. A recess 27 is shown in the edge plate 23 opposite bolt opening 25 to receive the dead bolt. The recess 27 is of sufficient width to receive the dead bolt and of sufficient depth to impeded lateral movement of the dead bolt when the waist chain is pulled.

Figure 3:
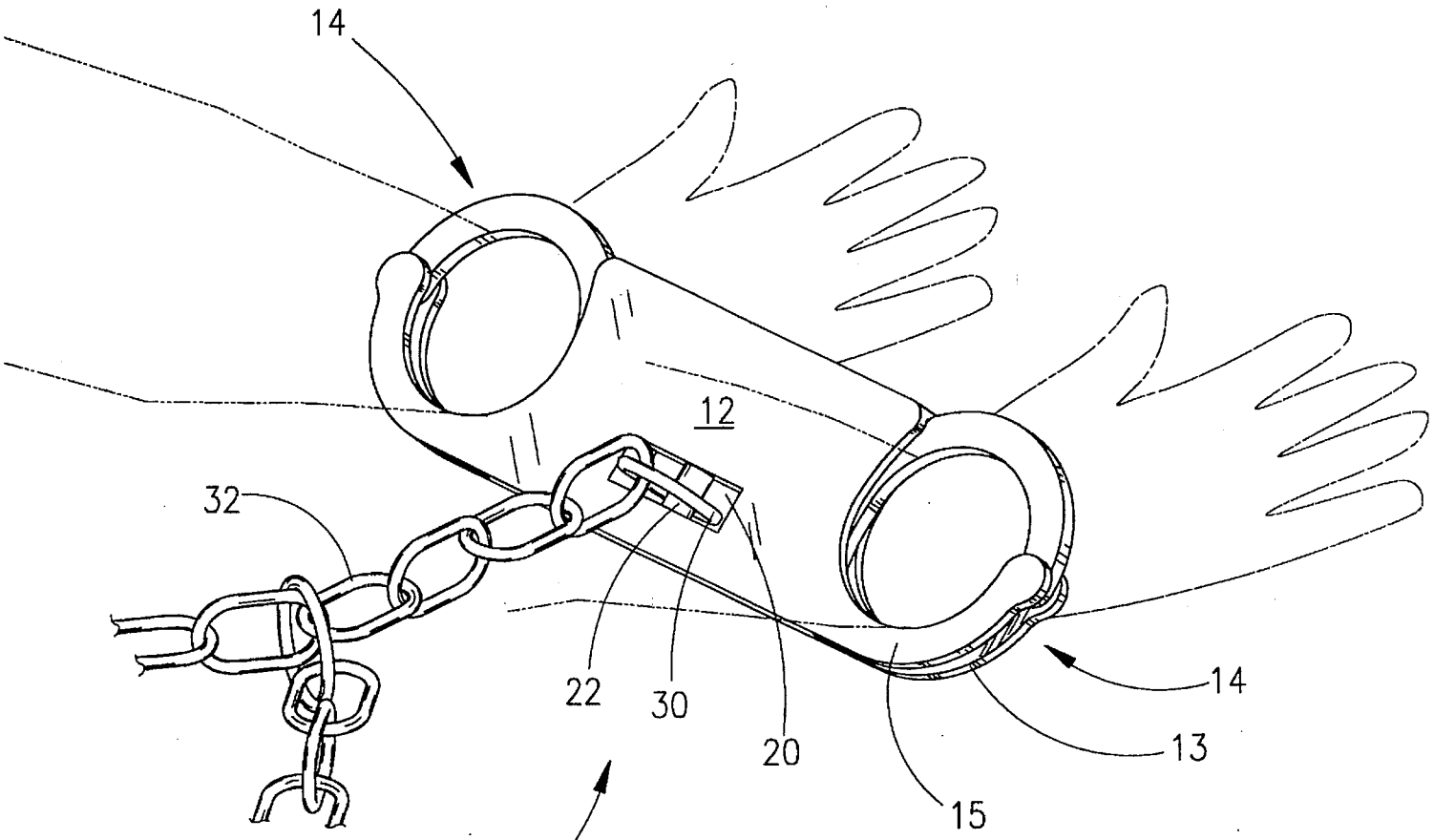
FIG. 3 shows a perspective view of the handcuff assembly receiving a link from a prisoner's waist chain.

In use, as illustrated in FIG. 3, the wrist cuffs 14 of the handcuff 10 are attached to the prisoner's wrists to restrain the prisoner's hands. After the cuffs 14 are attached to the wrists, a link 30 of the prisoner's waist chain 32 is inserted into the open slot 20. The dead bolt 22 is then pushed through the slot 20 and the link 30 by the key and locking means 26 to secure the link 30 and the waist chain 32 to the handcuffs 10. This slot and dead bolt combination allows the guards to rapidly insert and secure the waist chain without threading the entire chain through or around the cuffs.

Figure 4:
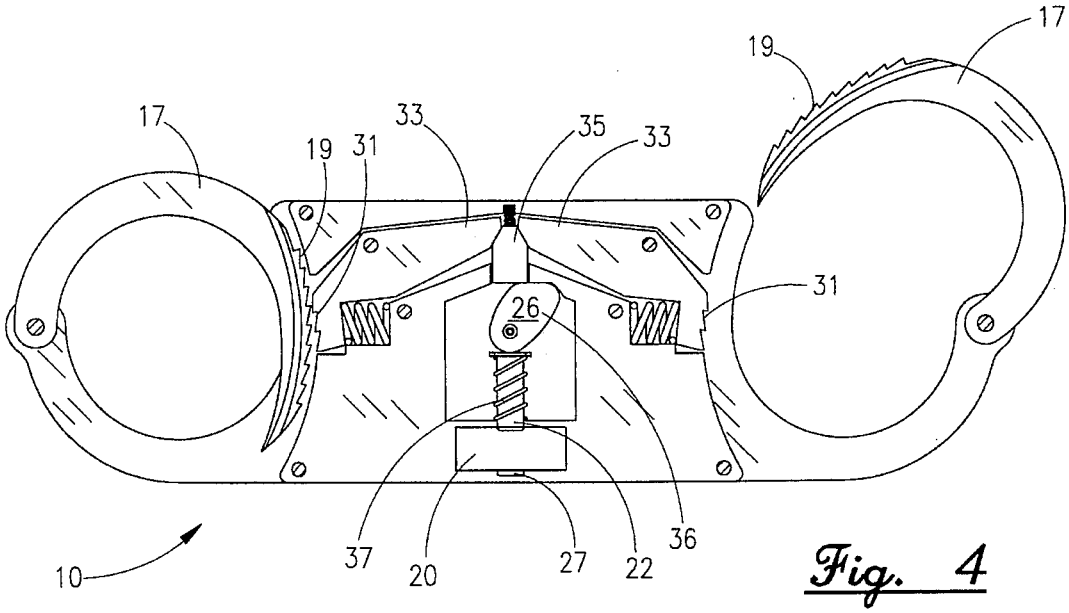
FIG. 4 shows is a cut-a-way view of the hand cuff assembly showing the locking mechanism with the wrist cuffs and the waist chain dead bolt in the open position.
Figure 5:
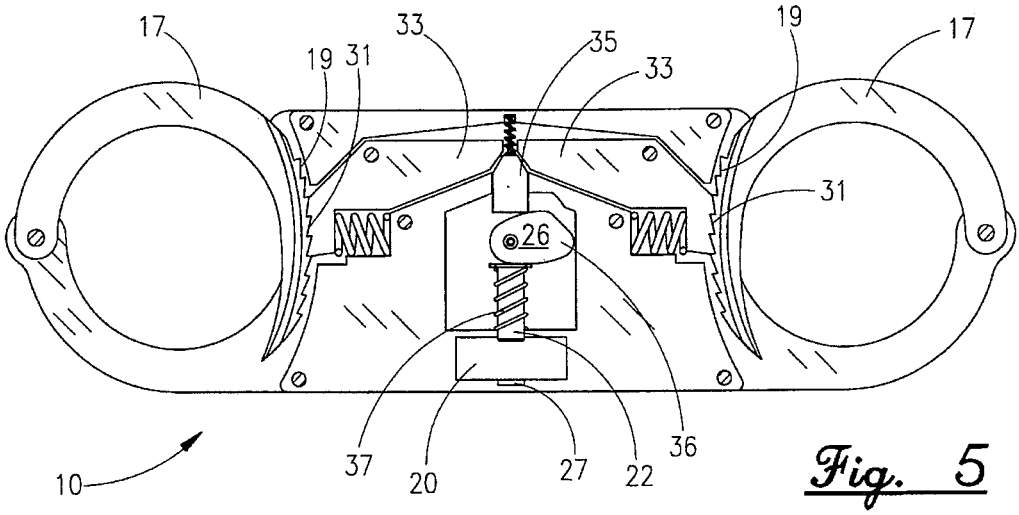
FIG. 5 shows is a cut-a-way view of the hand cuff assembly showing the locking mechanism with the wrist cuffs in the closed position and the waist chain dead bolt in the open position.
Figure 6:
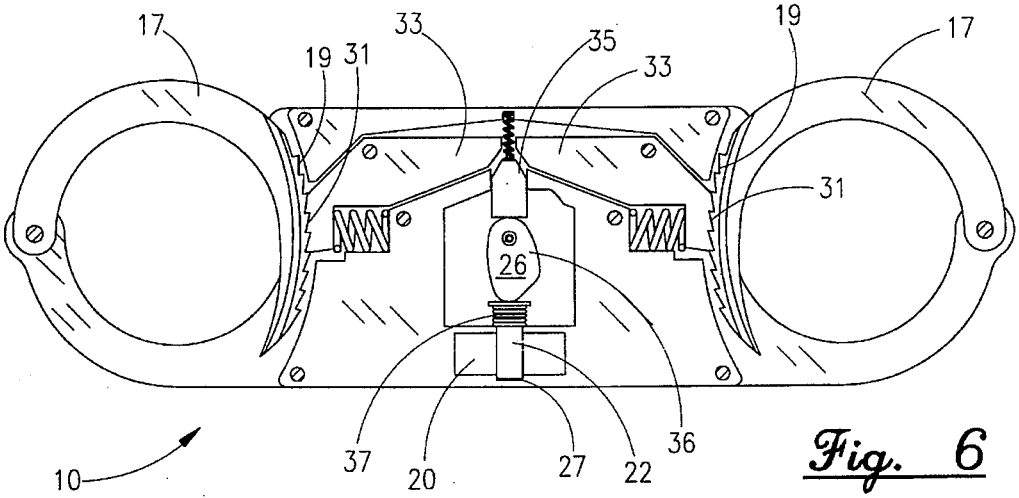
FIG. 6 shows is a cut-a-way view of the hand cuff assembly showing the locking mechanism with the wrist cuffs in the closed position and the waist chain dead bolt in the closed position.

FIGS. 4 through 6 illustrate the central locking mechanism 26 which allows the waist chain dead bolt and wrist cuffs to be open and closed with a single key. In the preferred embodiment, a cam lock with a star shaped tubular key is utilized as the central lock mechanism 26.

FIG. 4 shows the principal components of the central locking mechanism 26 with the wrist cuffs and waist chain dead bolt in the open position. The locking mechanism is comprised of a pair of spring biased pawls 33 having teeth 31 for engaging the corresponding teeth 19 of the wrist shackles 17. These pawls are moved in and out of engagement with the shackles 17 by means of a spring biased cam pin 35 which is positioned by turning the lock cam 36. The lock cam 36, as it is turned with the key, also positions the spring biased waist chain dead bolt 22 which is held in open position by dead bolt spring 37.

FIG. 5 shows the locking mechanism 26 with the cam lock 36 positioned so as to engage the pawls 33 with the shackles 17 to lock the wrist cuffs. At this stage, the waist chain dead bolt 22 is still in the open position, leaving the waist chain slot 20 clear for receiving a link from the prisoners waist chain.

FIG. 6 shows the locking mechanism 26 with the cam lock 36 positioned so as to engage the pawls 33 with the shackles 17 to lock the wrist cuffs and to further engage the waist chain dead bolt 22 and push it through the opening 23 across slot 22 to secure a link 30 from the prisoner's waist chain 32. The dead bolt 22 is of sufficient length to be positioned in recess 27 when the dead bolt is in the fully closed position through the slot 20.

It is thought that the improved handcuff design of the present invention and many of its attendant advantages will be understood from the foregoing description and it will be apparent that various changes may be make in the form, construction and arrangement of the parts thereof without departing from the spirit and scope of the invention or sacrificing all of its material advantages, the form described herein being merely a preferred or exemplary embodiment of the invention.

I claim:

1. In a handcuff, for use in conjunction with a prisoner's waist chain, having a rigid central body comprised of a pair of rigid parallel plates and lockable wrist shackles at each end of said rigid body, an improvement wherein:

(a) said parallel plates of said central body have a slot for receiving a prisoner's waist chain; and (b) said central body further includes a dead bolt and lock set means mounted between said parallel plates within said central body for extending said dead bolt through said slot between said rigid plates for engagement with said prisoners waist chain.

2. A handcuff improvement as recited in claim 1, wherein said slot has a lining plate around its periphery between said rigid plates, said lining plate having an opening for passage of said dead bolt through said slot.

3. A handcuff improvement as recited in claim 2, wherein said lining plate has a recess for receiving said dead bolt after said dead bolt is extended through said slot.

4. A handcuff improvement as recited in claim 1, wherein said lock set means is a single, key-operated, mechanism for opening and closing said dead bolt and said wrist shackles.

5. A handcuff improvement as recited in claim 3, wherein said lock set means is a single, key-operated, mechanism for opening and closing said dead bolt and said wrist shackles.

6. A handcuff for use in conjunction with a prisoner's waist chain, comprising:

(a) a rigid central body, said body having a slot through its width for receiving a link of said waist chain;

(b) a pair of wrist shackles mounted to said body;

(c) a dead bolt mounted within said body for engaging said waist chain link through said slot; and (d) a lock set means mounted within said body for opening and closing said wrist shackles and positioning said dead bolt through said slot to engage said waist chain link.

7. A handcuff as recited in claim 6, wherein said lock set means is operated by means of a tubular key.

8. A handcuff as recited in claim 7, wherein said body has a recess adjacent to said slot to receive said dead bolt so as to impede lateral movement of said dead bolt with respect to said body when said waist chain is pulled.

9. A method of restraining a prisoner, comprising the steps of:

(a) attaching a linked waist chain around the waist of said prisoner;

(b) providing set of handcuffs for attachment to the wrists of said prisoner, said handcuffs having a having a rigid central body with a slot to receive a link from said prisoner's waist chain and a dead bolt and lock set means for extending said dead bolt through said slot;

(c) attaching said handcuffs to the wrists of said prisoner;

(d) inserting a link of said prisoner's waist chain through said slot and said waist chain link; and (e) extending said dead bolt through said slot so as to engage and hold said waist chain link and secure said waist chain to said handcuffs.

* * * * *